United States Patent [19]

Kelly

[11] 4,439,935

[45] Apr. 3, 1984

[54] CONVERTIBLE HIGH STYLE FOOTWEAR

[76] Inventor: Celeste Kelly, 4302 W. Greenway, Glendale, Ariz. 85023

[21] Appl. No.: 389,419

[22] Filed: Jun. 17, 1982

[51] Int. Cl.[3] ..... A43B 3/24; A43B 3/12

[52] U.S. Cl. ..... 36/101; 36/100; 36/115; 36/15

[58] Field of Search ..... 36/100, 101, 15, 11.5

[56] References Cited

U.S. PATENT DOCUMENTS

| | | | |
|---|---|---|---|
| 2,651,117 | 9/1953 | Harris | 36/11.5 |
| 3,119,191 | 1/1964 | Vitzthum | 36/100 |
| 3,474,477 | 10/1969 | London et al. | 36/11.5 |
| 3,925,915 | 12/1975 | Colli | 36/11.5 |
| 4,193,214 | 3/1980 | Wang | 36/101 |
| 4,267,650 | 5/1981 | Bauer | 36/101 |
| 4,300,256 | 11/1981 | Laganas | 36/11.5 |

*Primary Examiner*—Werner H. Schroeder
*Assistant Examiner*—Steven N. Meyers
*Attorney, Agent, or Firm*—James F. Duffy

[57] ABSTRACT

A shoe comprising a shoe base and an interchangable shoe upper. The interchangable shoe upper comprises a vamp and insole as a unit-construction with means for attachment to the shoe base. The shoe base has means for attachment to the shoe upper unit assembly.

7 Claims, 6 Drawing Figures

FIG. 1
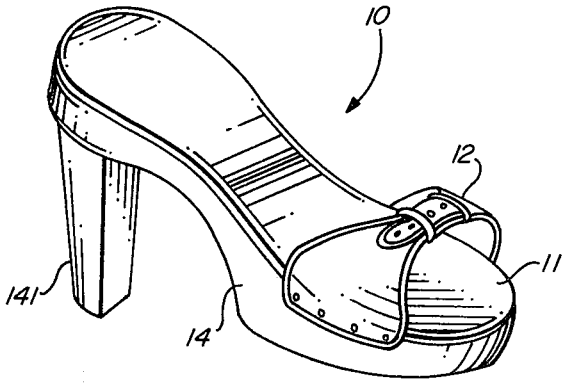
FIG. 2
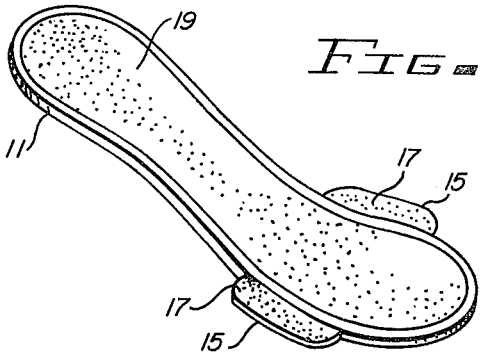
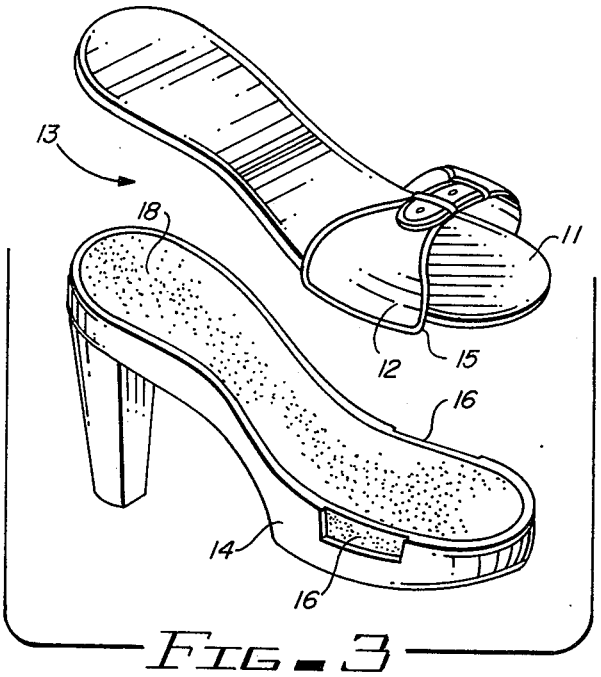
FIG. 3
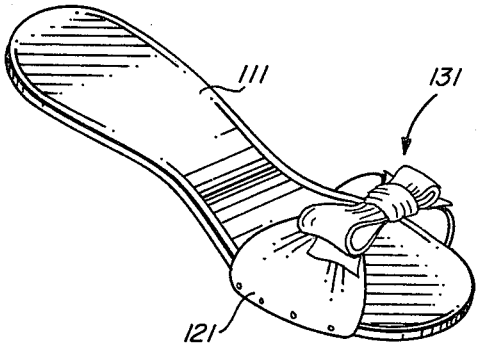
FIG. 4
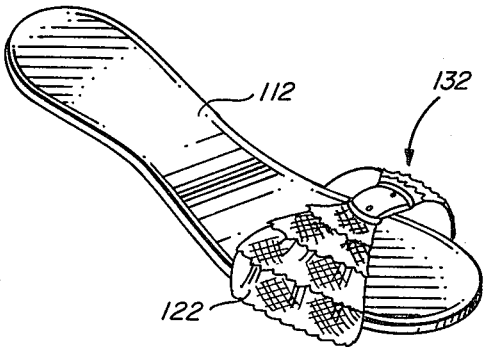
FIG. 5
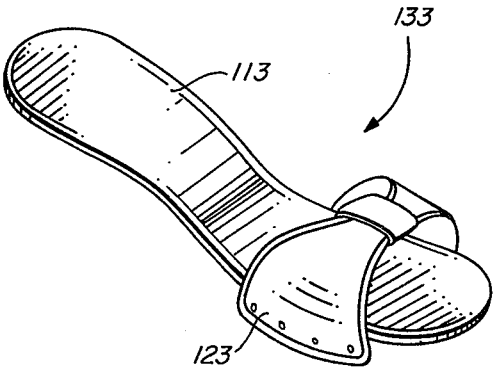
FIG. 6

CONVERTIBLE HIGH STYLE FOOTWEAR

BACKGROUND

1. Field of the Invention

This invention relates to the field of footwear.

In particular, the invention relates to footwear with a readily changeable appearance to suit the taste of the wearer.

Specifically, the invention relates to footwear having an interchangeable vamp and attached insole assembly such that a common shoe base will serve a variety of fashion-styled color coordinated vamp and attached insole assemblies.

2. Prior Art

In recent years there has been a fashion craze in a particular type of women's footwear causing a large influx of this particular type of shoe into the marketplace by a number of manufacturers. Although the shoe design has no specific name, the shoe consists of a one-piece shoe base, generally made of plastic or wood, and a strip of fabric in a particular color across the front of the shoe constituting the vamp. If a woman wanted to keep in style, she would have to have many pairs of the shoes to color coordinate with her wardrobe, causing her much expense and much clutter in her closet.

Those skilled in the prior art have recognized the need for a shoe with an interchangeable upper so that the syle or color of the shoe could be changed so as to coordinate with the garment of the wearer. Some of these shoes actually constitute a complete shoe in and of itself, in a neutral color, with a panel of color that attaches to a complete shoe assembly.

In the patents issued to Weaver, U.S. Pat. No. 3,032,896 and Fischer, U.S. Pat. No. 2,583,826, complete shoes in neutral colors were disclosed. These included a changeable piece or pieces that affix to the upper of the complete shoe to allow for color coordination of these pieces with the garment of the wearer. Neither of the shoes, however, provided for the changing of color of the insole area, which many people dressing in high style would desire when wearing an open shoe where the insole is generally visible around the periphery of the wearer's foot. In addition, these shoes severly limited the wearer's ability to change the style of the uppers because the shoes actually consisted of a complete shoe. The exchangeable pieces merely covered the vamp or were simply inserted into a permanently affixed, but open, vamp.

Taicher, in his 1959 U.S. Pat. No. 2,887,795, also taught a complete, closed type shoe with means for affixing a plurality of ornamental devices at the vamp area. However, the color and style of the entire shoe remained unchanged.

Others skilled in the prior art have taught of shoes with mechanical means of interchanging certain upper parts of the shoe. Patents issued to Gardiner, U.S. Pat. No. 2,761,224; Twiggs, U.S. Pat. No. 3,016,630; Lockard, U.S. Pat. No. 3,204,346; and Wang, U.S. Pat. No. 4,193,214 all disclose such a shoe wherein interchangeable uppers may be fixed to a shoe base by some mechanical means. Gardiner and Lockard disclosed shoes with a shoe base having tracks into which interchangeable uppers may be slid. Each of these shoes had a shoe base that consists of a multitude of pieces, including a shoe base with a welt and a permanently affixed insole, as in Gardiner; or a multi-piece assembly comprised of a shoe base with permanently affixed sole, midsole and sock lining, as in Lockard. In both cases, however, the insole, although generally visible about the periphery of the wearer's foot, was not interchangeable and its color had to remain neutral.

Wang discloses a shoe with a shoe base having circular slots into which a binding web with circular fasteners fit. Although the uppers were changeable, the insole was fixed to the shoe base and could not be changed. Thus, as in Lockard's and Gardiner's inventions, the insole, although visible about the periphery of the wearer's foot, could not be changed in color to coordinate with the upper in use.

Twiggs, in U.S. Pat. No. 3,016,630, issued Jan. 16, 1962, provided a shoe assembly of a multiplicity of parts reminiscent of the shoes of Wang, Lockard, and Gardiner, discussed above. Interlocking recesses and projections were employed to hold upper, exchangeable portions of the shoe to a composite shoe base comprised of outsole, midsole, and insole. A sock liner having projections thereon interlocked with recesses in the composite shoe base to retain the assembly intact. No provision was made for substituting various color coordinated sock liners with various exchangeable upper shoe portions. This was probably because the relatively complicated structure of the insole required various projections which had to be precisely emplaced to mate with recesses in the composite shoe base. Such construction made the sock liner itself relatively expensive to produce and thus costly to purchase.

Twiggs thus does not teach the exchange of a sock liner to fashionably color coordinate with exchangeable upper portions of a shoe assembly. In addition, the multiplicity of parts makes them susceptible to loss thus rendering the shoe assembly less useful and more costly to the consumer.

In U.S. Pat. No. 2,507,120 issued to Shapiro, a shoe was disclosed with interchangeable uppers fastened to a shoe base by means of snap fasteners. This shoe consisted of a shoe base with a permanently affixed insole which could not be color coordinated with the interchangeable uppers.

Danielus, in U.S. Pat. No. 2,552,943, taught a shoe having uppers which could be affixed to a shoe base by a removable rod that interlocked the uppers to shoe base. Like Shapiro above, Danielus' shoe did not include a changeable insole that could be coordinated with the changeable uppers. Additionally, Danielus' shoe requires the use of rods or wires to attach the uppers to the shoe base and these may be easily lost if the shoe were stored as component pieces, or while changing the uppers. This would render the invention less useful and more expensive.

Smith, in U.S. Pat. No. 2,809,449, disclosed a shoe with an interchangeable upper including an attached insole. Smith's shoe, however, was of a closed design having an insole not visible about the periphery of the wearer's foot. Smith's shoe provided for attachment of the upper to the shoe base only at the peripheral junction of the upper with the shoe base, leaving the center of the insole actually unattached to the shoe base, allowing for the possibility of the insole flapping against the wearer's foot.

All the prior art teaches shoes with interchangeable uppers having relatively complicated means of construction of the shoe base or complicated means of attachment of the uppers. The mechanical means of attachment consist of a multiplicity of parts allowing for easy loss of the component parts or causing much expense in production. Additionally, none of the prior art teaches of a shoe with an interchangeable insole wherein the insole is generally visible about the periphery of the wearer's foot, and the wearer would desire to color coordinate such a visible insole with the changeable upper portions of the shoe.

It is an object of this invention to provide for a shoe with an interchangeable upper that avoids the disadvantages of the prior art.

It is another object of this invention to provide a shoe with an interchangeable upper comprising a vamp and attached insole as a unit construction.

It is a further object of the invention to provide a shoe with an interchangeable upper that consists of a vamp and attached insole where the insole is generally visible around the periphery of the wearer's foot when the shoe is worn.

It is a specific object of the invention to provide a shoe with an interchangeable upper that consists of a vamp and an attached insole that are color coordinated.

It is a particular object of the invention to provide a shoe whose interchangeable upper attached to the shoe base by means of a hook and loop fastener.

SUMMARY OF THE INVENTION

The invention is a shoe with a replaceable vamp and insole. It comprises a shoe base, and a vamp and attached insole, as a unit construction, that may be removed and attached to the shoe base at the will of the wearer. The shoe is an open style shoe, so that when the shoe is worn, the insole is generally visible about the periphery of the wearer's foot. Since the insole is visible even when the shoe is worn, it is color coordinated to the attached vamp and interchangeable therewith as a unit.

In a preferred embodiment of the invention, the means for attaching the shoe upper to the shoe base is a hook and loop fastener. One part of the hook and loop fastener is attached to the shoe base, and the complimentary part of the hook and loop fastener is attached to the bottom of the insole. This provides for the means for fastening the shoe upper to the shoe base. In this embodiment, the lower end of the vamp is generally flush with the top of the shoe base.

In another presently preferred embodiment, the vamp extends below the insole and the top of the shoe base so as to cover a portion of the side of the shoe base. As in the previous embodiment, a part of the hook and loop fastener is attached to the shoe base and the complimentary part is attached to the bottom of the insole. However, in this embodiment, a part of the hook and loop fastener is attached to the underside of the vamp extensions on the sides adjacent to the shoe base, and the complimentary part of the fastener is attached to the shoe base where vamp extensions overlap the shoe base.

DESCRIPTION OF THE DRAWINGS

FIG. 1 is a perspective view of the complete shoe having a shoe base and removable vamp and attached insole.

FIG. 2 shows the underside of the shoe upper consisting of the insole with attached vamp and the means for attachment to the shoe base.

FIG. 3 is an exploded perspective view of the shoe showing the shoe base with means for attachment to the shoe upper, and the shoe upper removed from the shoe base.

FIG. 4 shows an alternate shoe upper.

FIGS. 5 and 6 show alternate, differently styled shoe uppers.

DETAILED DESCRIPTION OF THE INVENTION

For the purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

The shoe 10 is illustrated in perspective view in FIG. 1. Vamp 12 and insole 11 comprise a unit assembly 13 (FIG. 3). Vamp 12 and attached insole 11 are in position on the shoe base 14, but are detachable therefrom. Shoe base 14 is illustrated with a high heel 141 but this is for purposes of exposition, not limitation. Shoe base 14 may be a low heeled style, a flat shoe, a wedge type shoe, or any other style consumer taste may call for.

FIG. 3 shows the shoe upper, unit assembly 13 detached from the shoe base 14. In this embodiment, the shoe upper, unit assembly 13 comprises an insole 11 with an attached vamp 12 that extends below the insole 11 so as to have vamp extensions 15. Shoe base 14 has means for attachment to insole 11, such means for attachment comprising a part of a hook and loop fastener 18 inset in the surface of shoe base 14. Shoe base 14 also has a part of a hook and loop fastener 16 inset the side of shoe base 14 to couple with the complimentary part of the hook and loop fastener 17 (FIG. 2) affixed to the underside of vamp extensions 15.

FIG. 2 shows the underside of the shoe upper, unit assembly 13. Part of a hook and loop fastener 19 is affixed to the underside of shoe upper, unit assembly 13 to couple with the part of the hook and loop fastener 18 (FIG. 3) affixed to the shoe base 14. Additionally, vamp extensions 15 have part of a hook and loop fastener 17 affixed to their undersides to couple with the part of the hook and loop fastener 16 (FIG. 3) inset in the surface of shoe base 14.

Shown in FIG. 4 is another shoe upper, unit assembly 131 for an alternate embodiment of the shoe. In the immediate embodiment, shoe upper, unit assembly 131 consists of an insole 111 and a vamp 121 that does not have vamp extensions 15 (FIG. 3). This shoe upper, unit assembly 131 has hook and loop fastener 19 (FIG. 2) affixed to its underside to couple with hook and loop fastener 18 (FIG. 3) on shoe base 14. Since vamp 121 does not have vamp extensions 15 (FIG. 3), the need for hook and loop fastener 17 (FIG. 2) affixed to the underside of vamp extensions 15, and hook and loop fastener 16 inset to the sides of shoe base 14, is eliminated. In the immediate embodiment, vamp 121 ends flush with insole 111 and shoe base 14 when shoe upper, unit assembly 131 is in place on shoe base 14.

FIGS. 5 and 6 show alternate shoe upper, unit assemblies, 132 and 133, respectively, to illustrate the possible variations and style of the shoe merely by changing the vamps 121 and 123, respectively. These illustrations are merely for the purpose of exposition, not limitation, however, because of a multitude of variations in style are possible by merely changing the style or color of shoe upper, unit assembly 13 (FIG. 3) or shoe upper, unit assembly 131 (FIG. 4), as can be seen in FIGS. 5 and 6.

What has been disclosed is a shoe comprising a shoe base and an interchangeable shoe upper. The interchangeable shoe upper comprises a vamp and insole as a unit construction, with means for attachment to the shoe base affixed to the underside of the shoe upper, unit assembly. In addition, the shoe base has means for attachment to the shoe upper, unit assembly, inset in the top of the shoe base.

Those skilled in the art will conceive of other embodiments of the invention which may be drawn from the teachings herein. To the extent that such alternate embodiments are drawn, it is intended that they fall within the ambit of protection provided by the claims appended hereto.

Having set forth my invention in the foregoing specification and accompanying drawings in such a clear and concise manner that those skilled in the art may readily understand and practice the invention, that which I claim is:

1. A shoe with replaceable vamp and insole comprising:

shoe base means;

unit-construction shoe upper means adapted for removable coupling to said shoe base means including vamp means attached to an insole generally visible about the periphery of a wearer's foot;

coupling means for removably coupling said unit construction shoe upper means to said shoe base means; and said vamp further comprises a vamp extension extending below said attached insole and overlapping said shoe base.

2. The shoe of claim 1 wherein said unit-construction shoe upper comprises:

color coordinated insole and vamp means said insole being generally visible about the periphery of a wearer's foot and said color coordination being readily apparent to a viewer of said shoe when said shoe is in place on a wearer's foot.

3. The shoe of claim 1 or 2 wherein said coupling means for removably coupling said unit construction shoe upper means to said shoe base means comprises:

hook and loop fastener means.

4. The shoe of claim 3 wherein said hook and loop fastener means comprises:

hook fastener means affixed to at least one of said shoe base means and said unit-construction shoe upper means; and loop fastener means affixed to at least one of said unit-construction shoe upper means and said shoe base means in a manner to compliment said loop fastener means so as to removably couple said unit-construction shoe upper means to said shoe base means.

5. The shoe of claim 4 wherein:

said unit-construction shoe upper comprises a vamp extension below said insole for embraceably removably coupling said unit-construction shoe upper to the sides of said shoe base means; and said coupling means further comprises hook and loop fastener means for removably coupling said vamp extention means to the sides of said shoe base means.

6. A shoe assembly comprising:

a shoe base;

a shoe upper including a vamp and attached insole with said insole being generally visible about the periphery of the wearer's foot;

means for attachment and removal of said shoe base to said vamp and attached insole comprising a hook and loop fastener, wherein a part of said hook and loop fastener is affixed to the top of said shoe base, and the complementary part of said hook and loop fastener is affixed to the bottom of said insole; and said vamp further comprises a vamp extension extending below said attached insole and overlapping said shoe base.

7. The shoe assembly of claim 6 wherein means for attachment of said vamp and attached insole comprising said hook and loop fastener further comprises a part of said hook and loop fastener affixed to the underside of vamp extensions adjacent the side of said shoe base and the complementary part of said hook and loop fastener affixed to the sides of said shoe base adjacent said vamp extension.

* * * * *